US005613372A

United States Patent [19]

Beal et al.

[11] Patent Number: 5,613,372

[45] Date of Patent: Mar. 25, 1997

[54] HEAT PUMP SYSTEM DEHUMIDIFIER WITH SECONDARY WATER LOOP

[75] Inventors: David E. Beal, Augusta; Thomas P. Carson, Wells, both of Me.

[73] Assignee: Dumont Management, Inc., Monmouth, Me.

[21] Appl. No.: 451,447

[22] Filed: May 26, 1995

[51] Int. Cl.[6] ..... F25D 17/02

[52] U.S. Cl. ..... 62/434; 62/238.7; 62/428

[58] Field of Search ..... 62/90, 238.6, 238.7, 62/173, 428, 430, 434; 165/21

[56] References Cited

U.S. PATENT DOCUMENTS 4,270,362 6/1981 Lancia et al. ..... 62/173
5,228,302 7/1993 Eiermann ..... 62/90

*Primary Examiner*—John M. Sollecito
*Attorney, Agent, or Firm*—Daniel H. Kane, Jr.; Chris A. Caseiro

[57] ABSTRACT

A heat pump system dehumidifies air in an enclosure containing a source of humidity such as a swimming pool. The heat pump system invention transfers rejection heat from the primary refrigerant loop to a secondary water loop. The secondary water loop is coupled in heat exchange relationship to the primary condenser of the primary refrigerant loop for receiving the rejection heat including the latent heat and sensible heat from the refrigerant. The secondary water loop incorporates a circulating water pump and a storage tank and affords a substantially uniform load on the compressor, condenser and refrigerant of the refrigerant loop. The secondary water loop then provides versatility and flexibility in meeting variable load demand such as conditioning the enclosure air, heating water in open receptacles such as pools, dumping heat outside the enclosure, or adding heat to the enclosure. The secondary water loop displaces the variable load requirements from direct impact on the primary refrigerant loop. The invention is applicable for example to pools, natatoria, hot tubs, whirlpool baths, spas, fountains, fish tanks, locker rooms, showers, etc.

22 Claims, 5 Drawing Sheets

HEAT PUMP SYSTEM DEHUMIDIFIER WITH SECONDARY WATER LOOP

TECHNICAL FIELD

This invention relates to a new heat pump system for dehumidifying and conditioning air in an enclosure containing a source of humidity. The invention transfers all rejection heat from the primary refrigerant loop to a secondary water loop affording a more uniform load on the compressor and refrigerant loop. The secondary water loop then provides versatility and efficiency in meeting varying load demands such as conditioning the enclosure air, heating water in an open receptacle such as a pool, dumping heat outside the enclosure, or adding heat during colder seasons. The invention is applicable for example to enclosures for pools and other natatoria, hot tubs, whirlpool baths, spas, fountains, fish tanks, locker rooms, showers, etc.

BACKGROUND ART

A typical dehumidifier for a pool enclosure or similar enclosure for a source of humidity incorporates a refrigerant loop with a compressor, a variety of condensers for transferring heat, and an evaporator. The evaporator is used to chill enclosure air to the dew point for extracting moisture. The various condensers are used to heat the pool water or other open receptacle water and reheat the dehumidified enclosure air using the rejection heat. The rejection heat from the refrigerant includes the heat of vaporization of the refrigerant and sensible heat added by the compressor.

The condensers include a desuperheater which is a refrigerant to water heat exchanger (HX) for heating pool water or other open receptacle water such as hot tub, whirlpool bath, spa, shower water etc. Another condenser is the reheat coil, a refrigerant to air HX for reheating the enclosure air using rejection heat. Optional condenser heat exchangers can also be provided for discharging excess sensible heat outside the enclosure. In the case of a refrigerant to air or air cooled condenser for discharging excess heat, the condenser is located outside the enclosure. A refrigerant to water or water cooled condenser for dumping excess heat may be located inside the enclosure. Supplemental heat is added to the enclosure during colder seasons using a separate heating system.

A difficulty with the conventional heat pump system dehumidifiers is that variation in the heating or cooling load for the pool water and enclosure air directly varies the load on the compressor and refrigerant loop. The heat pump system is required to maintain the temperature and humidity of the enclosure air and temperature of the pool water within specified ranges despite variations in pool activity and outside weather conditions. Changes in the load may cause changes in parameters of the refrigerant loop including suction pressure and temperature at the compressor, superheat conditions entering the compressor, and condensing temperature and pressure at the condenser. Operating difficulties occur when changes in load cause refrigeration system parameters to oscillate impairing the efficiency of the heat pump system.

OBJECTS OF THE INVENTION

It is therefore an object of the present invention to provide a new heat pump system for dehumidifiers that stabilizes the load on the compressor and refrigerant loop. An advantage of the new system is that oscillation of refrigeration system parameters is avoided despite variations in load demand e.g. for maintaining receptacle water temperature, enclosure air temperature, and air humidity.

Another object of the invention is to displace variations in load requirements across the reheat coil, desuperheater, and discharge heat exchangers from the primary refrigerant loop to a secondary system and specifically a secondary water loop. All rejection heat from the refrigerant can be transferred to the secondary system at a substantially stable rate for maintaining refrigeration system parameters. The primary refrigeration or heat pump system is no longer subject to the pressure fluctuations at the compressor associated with desuperheaters. It is the secondary system that provides the versatility and capability of meeting changing load requirements. The primary refrigerant loop can be factory tested and installed without field modifications.

A further object of the invention is to provide a new heat pump system dehumidifier with a secondary system displaced from the primary refrigerant loop for supplemental heating and cooling in the secondary system without impacting the refrigerant loop. The secondary water loop permits supplemental heating with a boiler and sensible cooling using direct evaporative cooling such as a cooling tower. A storage tank can be used to store heat energy. Separation of the primary refrigeration circuit and secondary system also enhances modular construction for dehumidifier systems.

DISCLOSURE OF THE INVENTION

In order to accomplish these results the present invention provides a new heat pump system for dehumidifying air in an enclosure containing a source of humidity. The heat pump system includes a primary refrigerant loop of circulating refrigerant, a compressor for pressurizing refrigerant vapor, a primary condenser for extracting rejection heat from the refrigerant and condensing the refrigerant, and an evaporator for evaporating refrigerant and cooling air from the enclosure for condensing and extracting moisture from the air.

According to the invention a secondary water loop is coupled in heat exchange relationship to the primary condenser of the primary refrigerant loop for receiving the rejection heat from the refrigerant. The rejection heat includes the latent heat of vaporization of the refrigerant and sensible heat added by the compressor. The secondary water loop includes a circulating water pump for circulating water in the secondary water loop, and a storage tank for storing water containing the rejection heat. A water to air reheat coil is coupled in the secondary water loop for reheating air from the enclosure with the rejection heat after extracting the moisture and before returning the air to the enclosure.

An advantage of the secondary water loop is that the rejection heat from the primary refrigeration cycle and primary refrigerant loop can be transferred to the secondary water loop within a substantially stable and uniform range of operation. Variations in load demand can then be transferred to the secondary water loop which can receive and store the rejection heat at a substantially uniform rate. The variation in load demand therefore does not directly impact the refrigerant in the primary refrigerant loop. The secondary water loop can receive and store the rejection heat within a substantially uniform range of operation and then deliver the heat for various purposes hereafter described according to varying load demands.

Furthermore, the secondary water loop incorporates bypass valves and controls for bypassing respective loads and controlling the temperature of the water to the primary condenser in the refrigerant loop. The temperature of the water can be controlled to maintain constant compressor discharge conditions. The primary condenser is therefore no longer affected by changes in air temperature across the evaporator.

The invention also incorporates an excess heat discharge heat exchanger (HX) coupled in the secondary water loop for discharging excess rejection heat inside or outside the enclosure. The excess heat discharge HX can be a water to air heat exchanger outside the enclosure coupled in series with the water to air reheat coil in the secondary water loop. If the water to air excess heat discharge HX is located inside the enclosure it can be ducted with outside air. Such outside air may be supplied through a duct or duct-work commonly known throughout the heating and cooling arts. In the preferred example a multiway valve and multiple water lines are coupled between the water to air reheat coil inside the enclosure and the discharge HX outside the enclosure for bypassing the water to air reheat coil during a cooling mode of operation. The excess heat discharge HX outside the enclosure can be a water to air evaporative condenser. A water to water heat exchanger can also be used for the excess heat discharge HX in the secondary water loop either inside or outside the enclosure for transferring excess heat to a tertiary water system.

The air flow plan according to the present invention can also be used to supplement energy flows. The air flow plan includes exhaust air to the atmosphere and outside make-up air to maintain air quality. Bypass air is also used to control system parameters and for mixing with outside air to average conditions.

The system dehumidifier with secondary water loop according to the invention is applicable to a variety of enclosures with sources of humidity. The source of humidity may be for example swimming pools, natatoria, spas, hot tubs, whirlpool baths, bathtubs, showers, fountains, wading pools, aquaria, fish tanks, and any open water receptacles. According to the invention single or multiple water to water heat exchangers are also incorporated in the secondary water loop for transferring the heat to tertiary water systems. For example the water to water HX is used for heating the receptacle water with rejection heat received in the secondary water loop from the refrigerant circulating in the primary refrigerant loop.

A feature and advantage of the heat pump system with secondary water loop is the versatility of heating and cooling capabilities using the secondary water loop without directly impacting the primary refrigeration cycle. As noted above the rejection heat transferred to the secondary water loop can then be used to reheat the enclosure air, heat any receptacle water within the enclosure, and for other space heating or water heating requirements. Excess heat can readily be dumped outside the enclosure. Furthermore, a boiler can be incorporated in the secondary water loop for adding heat in colder climates or during colder seasons.

A conventional desuperheater heat exchanger can optionally be used in combination with the secondary water loop of the present invention. Such a refrigerant to water heat exchanger can be used for heating water to higher temperature than can be achieved with the secondary water loop. Direct water heating from the refrigerant can achieve the higher water temperatures.

The secondary water system and water loop introduced into the heat pump system by the present invention is able to respond with great flexibility to varying load requirements without directly impacting the compressor and refrigerant in the refrigeration system. In response to changing weather conditions and changing activity in the enclosure, the secondary water system can respond with more or less heat transferred to the enclosure air, receptacle water and other space heating and water heating requirements. Excess heat can be dumped outside the enclosure or heat can be added from an external source to the enclosure via the secondary water system. This flexibility is achieved in the secondary water loop while transfer of rejection heat from the primary refrigerant loop and refrigeration cycle can be maintained within a substantially uniform range. Thus the varying load demands do not directly impact the system operation of the compressor, condenser, and refrigerant. The secondary water loop minimizes the pressure fluctuations and pressure oscillations caused by load changes directly on the refrigerant in the primary refrigeration circuit.

A further advantage of the secondary water system according to the present invention is that the refrigeration circuit can be factory tested and sealed for installation. Field modification of the primary refrigeration loop is no longer required. The refrigeration or heat pump circuit portion of the system can be fabricated as a single module. Sensible heating and cooling is left to the secondary water loop which can incorporate water to air heat exchange, water to water heat exchange, direct evaporative cooling, and indirect evaporative cooling. The storage tank in the secondary water line permits substantially uniform transfer of rejection heat from the primary refrigerant loop to the secondary water loop, with variation in dispensing of heat energy from the secondary water loop according to variable load requirements.

Other objects, features, and advantages of the invention are apparent in the following specification and accompanying drawings.

DESCRIPTION OF PREFERRED EXAMPLE EMBODIMENTS AND BEST MODE OF THE INVENTION

Figure 1:
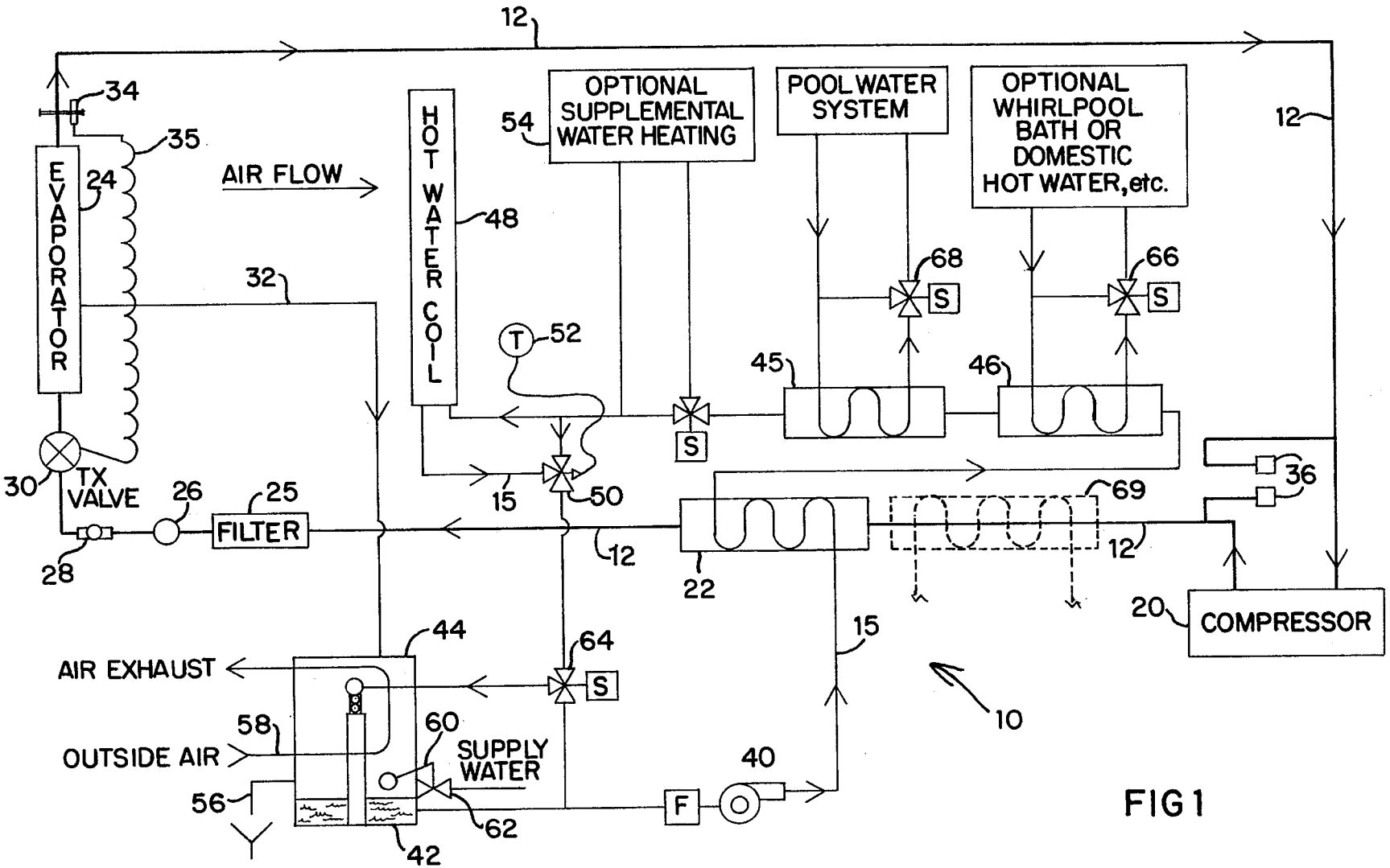
FIG. 1 is a schematic circuit diagram of the heat pump system dehumidifier with secondary water loop according to the invention applied to a swimming pool and swimming pool enclosure.

A dehumidifier with water and air conditioning system 10 according to the invention is illustrated in FIG. 1. The dehumidifier and conditioning system is applied for example to a swimming pool enclosure which include s a whirlpool bath. The dehumidifier and conditioning system 10 incorporates a primary refrigerant loop 12 with circulating refrigerant in a heat pump or refrigeration system. The primary refrigeration loop is indicated by the darker line 12. The dehumidifier and conditioning system 10 also incorporates a secondary water loop 15 to which is transferred all of the rejection heat from the refrigerant loop 12. The secondary water loop for circulating water is shown by the lighter line 15.

The primary refrigerant loop 12 incorporates conventional refrigeration cycle or heat pump cycle components including compressor 20, primary condenser 22, and evaporator 24. The compressor 20 pressurizes refrigerant vapor of a refrigerant such as, for example, R22. At primary condenser 22, the compressed hot vapor gives up much of its heat to water circulating in the secondary water loop 15. As the refrigerant vapor gives up the latent heat of vaporization as well as some sensible heat to water circulating in the water loop 15, the refrigerant condenses to a liquid and passes through the liquid filter 25, control solenoid valve 26, and sight glass 28 to the thermal expansion valve (TX valve) 30.

The TX valve 30 allows liquid refrigerant under pressure to expand into the evaporative coils of evaporator 24. The refrigerant liquid vaporizes to refrigerant vapor picking up heat from the air flowing over the evaporator coils. The moist air from the pool enclosure or other source of humidity is refrigerated or chilled to or below its dew point and the moisture in the air condenses on the evaporator surfaces. The condensate moisture from the evaporator 24 is collected and drained through line 32 to a water tank in the secondary water loop 15 as hereafter described.

The opening on thermal expansion valve 30 for expansion and vaporization of liquid refrigerant in the evaporator 24 can be varied according to the load on the evaporator and refrigerant loop. This is accomplished by a sensor 34 such as a temperature sensor coupled in heat conducting relationship to the refrigerant loop 15 at the outlet of evaporator 24. Temperature sensitive liquid in the sensor line 35 controls the opening of the TX valve 30. Refrigerant vapor returns from the outlet of evaporator 24 to the inlet of compressor 20 which is provided with a test port 36 for testing the compressor suction pressure and temperature.

It is noted that the only load on the primary refrigerant loop 15 other than evaporator 24 is the primary condenser 22 coupled in heat exchange relationship with the secondary water loop 15. All rejection heat from the refrigerant loop, that is all latent heat of vaporization as well as sensible heat added by the compressor, is transferred to the secondary water loop 15 by the primary condenser 22. This transfer can be maintained within a substantially uniform range in comparison with refrigerant cycles and heat pump systems where the refrigerant in the refrigerant loop 12 is used per se for transferring heat to a variety of different loads such as pool water heating, enclosure air heating, and other hot water heating uses. Instead of imposing variable loads directly on the refrigerant circulating in primary refrigerant loop 12, all of the rejection heat is transferred by the primary condenser 22 to the secondary water loop 15. The rejection heat can be transferred within a substantially uniform range of operation so that the primary condenser 22 functions as a substantially uniform load on the refrigerant in refrigerant loop 12.

Turning to the secondary water loop 15, water is circulated in the loop by water pump 40 and water can be stored in the water tank or reservoir 42 which in this example is part of an evaporative condenser 44 as hereafter described. A separate water storage tank in the secondary water loop 15 can also be used. Water circulating in the secondary water loop 15 passes from the water pump 40 through the primary condenser 22 which is a refrigerant to water heat exchanger. Condenser 22 may be constructed for example as a plate type heat exchanger although any other refrigerant to water heat exchanger can be used. Water passing through condenser 22 picks up the rejection heat from refrigerant circulating in the refrigerant loop 12. The heated water may then be used for transferring heat to a variety of loads which are coupled to the secondary water loop 15 rather than the primary refrigerant loop 12.

One example of a heat exchanger for primary condenser 22 is a brazed plate refrigerant to water HX. Other heat exchangers in the secondary water loop may be, for example, brazed plate water heaters. The capacity of such plate type heat exchangers is dependent upon the expected load. By way of example, a 60,000 BTU/hr plate type heat exchanger requires approximately 20 plates of a size approximately 12" (30 cm)×5" (12.5 cm). Any other type heat exchanger can of course also be used.

The variety of loads coupled to the secondary water loop may include for example the pool water heating system provided by heat exchanger 45. The pool water heat exchanger 45 is a water to water heat exchanger which may also be a plate type heat exchanger. The pool water system constitutes a tertiary water system coupled to the secondary water loop by HX45. A variety of other tertiary hot water heating systems may be coupled to the secondary water loop 15 such as, for example, whirlpool bath or a domestic hot water heat exchanger 46. Heat exchanger 46 is also a water to water heat exchanger and may be for example a plate type heat exchanger although any other water to water HX can also be used.

Moist air passing through the evaporator coils and dehumidified by chilling to the dew point can also be reheated using water from the secondary water loop. As shown in FIG. 1 the secondary water loop can include hot water air heating coils 48 for reheating the dehumidified enclosure air. Rejection heat is transferred back to the air flow passing through the hot water coil 48. A three way valve 50 is provided for directing hot water circulating in the secondary water loop 15 through the hot water coil 48 or for bypassing the hot water coil 48 according to one of three modes of operation. During the air heating mode all or part of the circulating water is directed by three way valve 50 through the hot water coil 48. During the air cooling mode the three way valve 50 set to bypass the hot water coil, directing all hot water in the secondary water loop 15 away from the hot water coil 48. During a dehumidification mode the water flow through hot water coil 48 is modulated by the three way valve 50 to maintain a constant air temperature of the air flow passing through the hot water coil as sensed by temperature sensor 52.

The temperature sensor 52 that controls the reheat coil 3-way valve is located in the supply enclosure air stream, that is the air entering the enclosure. This is the control that allows the reheat coil to maintain the air entering the space at a constant temperature during the dehumidification mode. A humidistat in the pool enclosure turns on the compressor and enables the system to operate in the dehumidification mode. A thermostat in the pool enclosure also turns on the compressor and enables the system to operate in either the heating or cooling mode.

The secondary water loop 15 also permits excess rejection heat from the refrigerant to be discharged or dumped outside the enclosure which is enclosing a source of humidity, in this case a swimming pool and associated whirlpool bath. In the example of FIG. 1, excess heat is discharged by a water to air evaporative condenser 44. Water to air heat exchange is used for discharging the excess heat. Evaporative condenser 44 is located outside the enclosure or if inside can be ducted with outside air as shown in FIG. 1. The hot water in the secondary water loop 15 passes through heat conducting surfaces such as, e.g. coils, of the evaporative condenser 44 and into the water reservoir 42. Water from the reservoir 42 is sprayed over the heat conducting surfaces as an outside air flow 58 is established over the heat conducting surfaces. The outside air flow 58 is generally a counter flow to the spray over the heat conducting surfaces of evaporative condenser 44. Evaporating spray water carries off latent heat of vaporization as well as sensible heat. Because of the gradual loss of water from the reservoir 42 by vaporization to the outside air flow, a float valve 60 is provided in the tank 42 operating a water supply 62 for replenishing lost water in the secondary water loop 15. An overflow valve 56 is also provided. A three way valve 64 is provided for bypassing the evaporative condenser 44 when it is not necessary to discharge excess heat to the outside air or to control refrigerant condensing pressure in loop 12.

Discharge of excess heat can also be accomplished using water to water or water to other liquid heat exchangers for conducting heat outside the enclosure. In the case of water to water or water to other liquid heat exchangers, the heat exchanger can be located inside or outside the enclosure with water flow piping of the tertiary water system leading away for conducting the excess heat outside the enclosure.

The flexibility of the secondary water loop 15 is further demonstrated by the availability of supplemental water heating. A supplemental source of water heating 54 can be coupled in heat exchange relationship with the secondary water loop 15 to add heat during cold seasons. This may take the form of, for example, a boiler, solar hot water heaters, etc. The secondary water loop 15 affords great flexibility for either adding heat to the system or discharging heat from the system.

It is also noted that other three way valves are provided for bypassing the other load components on the hot water secondary water loop. Three way valve 66 can be used for bypassing the whirlpool bath or other domestic hot water heating system. Three way valve 68 can be used for bypassing the pool water heating system. And, the three, way valve 70 can be used for bypassing the supplemental water heating source 54 such as a boiler or other source of hot water for introducing heat into the secondary water loop during e.g. cold seasons.

The water tank 42, which in this example is a part of the evaporative condenser 44 can be insulated for storing heat from the heat pump system. Alternatively a separate water storage tank can be used in the secondary water loop which also can be insulated for storing heat. According to the size of the hot water storage tank, rejection heat from the heat pump system can be stored for later use rather than discharge into environmental air outside the enclosure. In this respect the secondary water loop provides great flexibility in addressing the requirements of various heating loads, in putting heat into the system, discharging heat out of the system, and storing heat for a variety of uses. The operation of the heat pump, system with secondary water loop can be varied according to the season and the average outside temperatures.

Another optional component that can be incorporated into the dehumidifier system is a conventional desuperheater 69. The desuperheater 69 is a refrigerant to water heat exchanger for directly heating water from the refrigerant rejection heat. Such a desuperheater is capable of heating water to a higher temperature than can be achieved through the secondary water loop. If higher temperature water therefore is required, then the optional desuperheater 69 can be added to the system.

Figure 2:
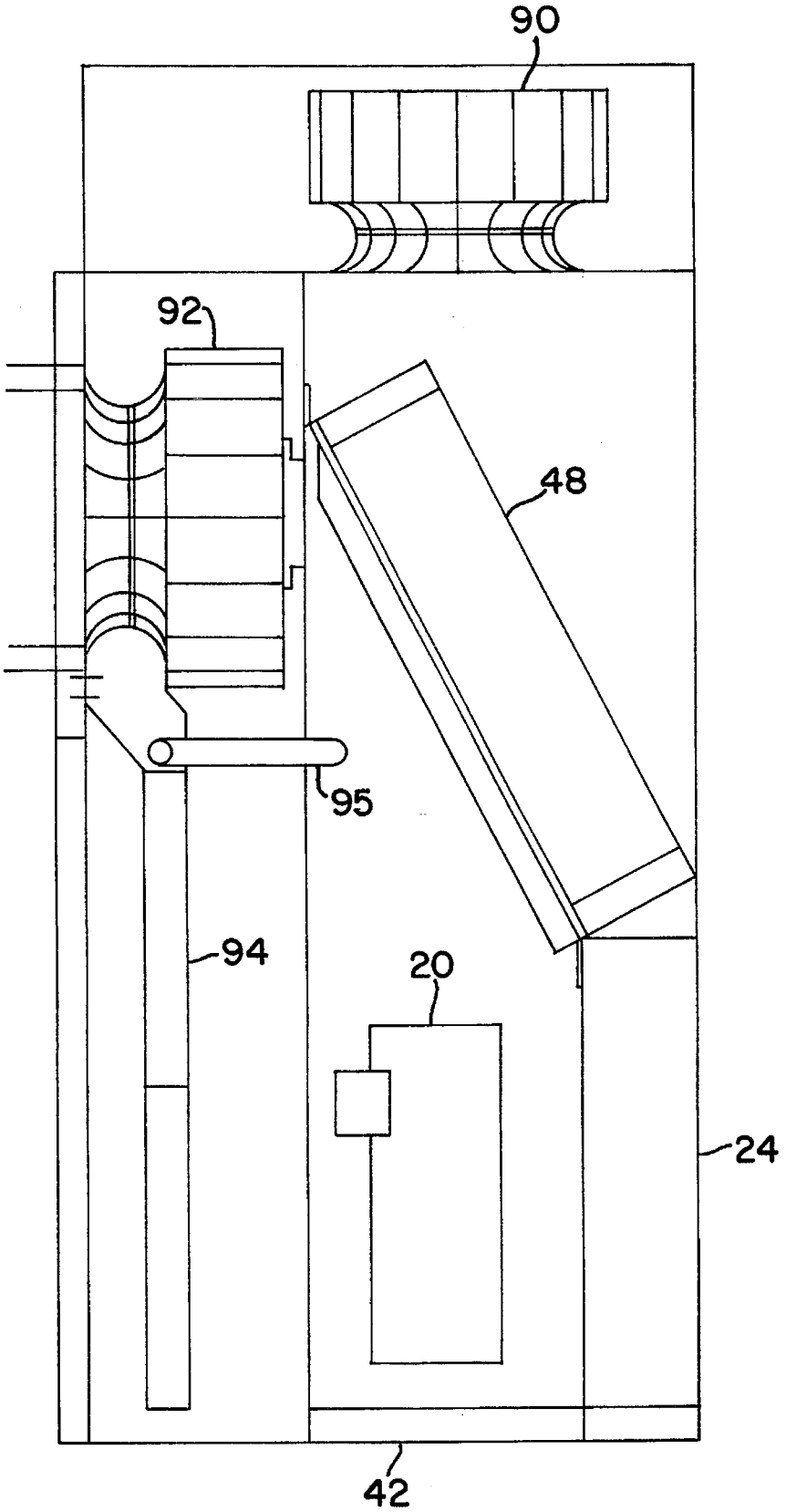
FIG. 2 is a simplified side diagrammatic view of an example heat pump dehumidification system according to the invention showing the layout of components for implementing the system of FIG. 1.

A dehumidifier unit incorporating the system of FIG. 1 is illustrated in FIG. 2 showing the air flow paths and air flow components. The main air supply fan 90 for enclosure air draws moist air from the enclosure through the evaporator 24. The moist air is chilled to its dew point, condenses on the evaporator surfaces, and drains into the water tank 42. The dehumidified air then passes through the hot water coils 48 for reheating the enclosure air. The fan or blower 90 then delivers the dehumidified and reheated enclosure air back to the enclosure. Isolated from this primary air path is the evaporative condenser fan 92 which provides air flow for the evaporative condenser through the evaporative media in the rack 94 of FIG. 2. Water tube 95 is the water distribution tube for the evaporative media. Compressor 20 is also shown.

Figure 3:
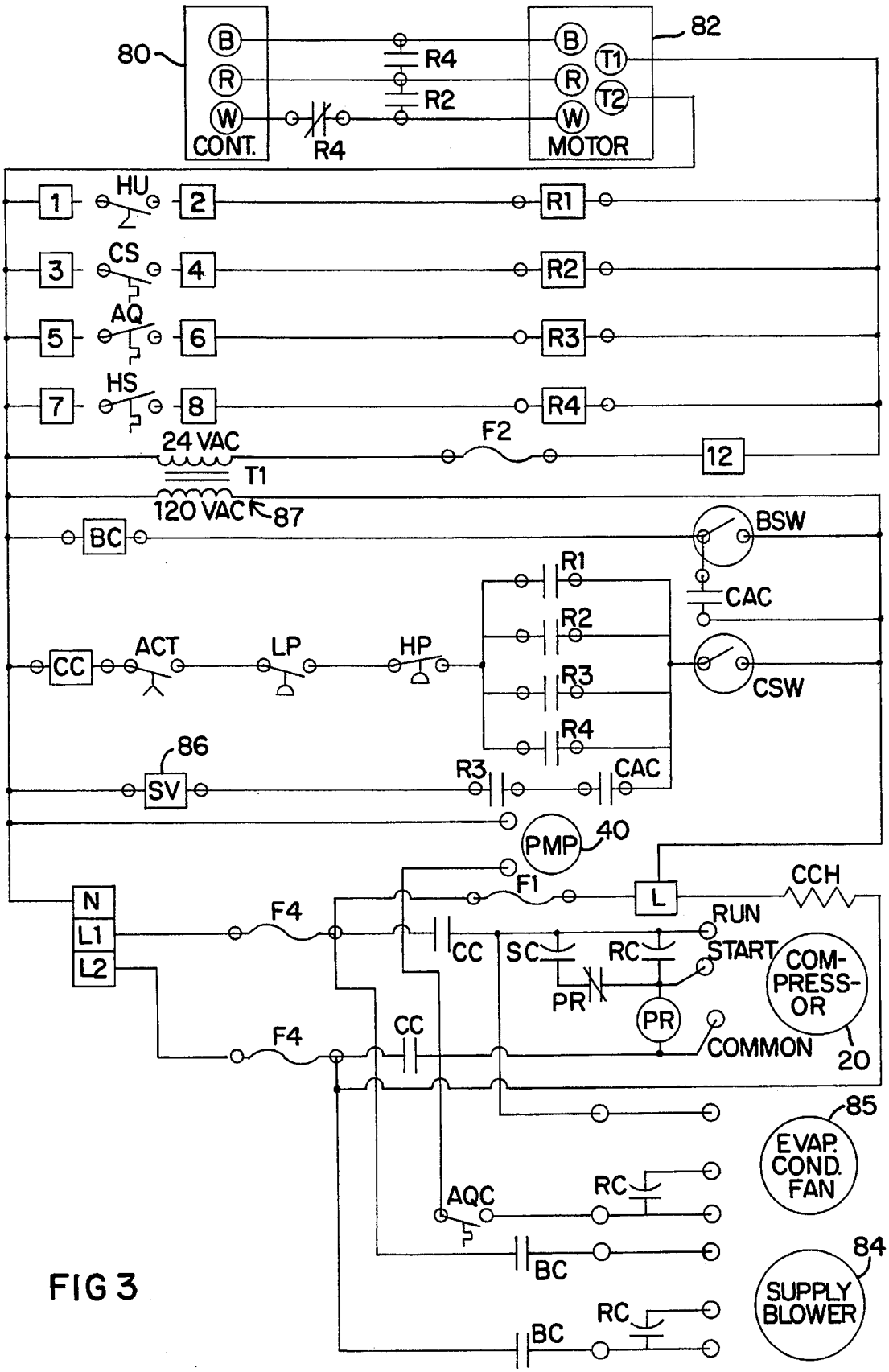
FIG. 3 is a schematic electrical circuit diagram of a control circuit for the heat pump system dehumidifier.
Figure 4:
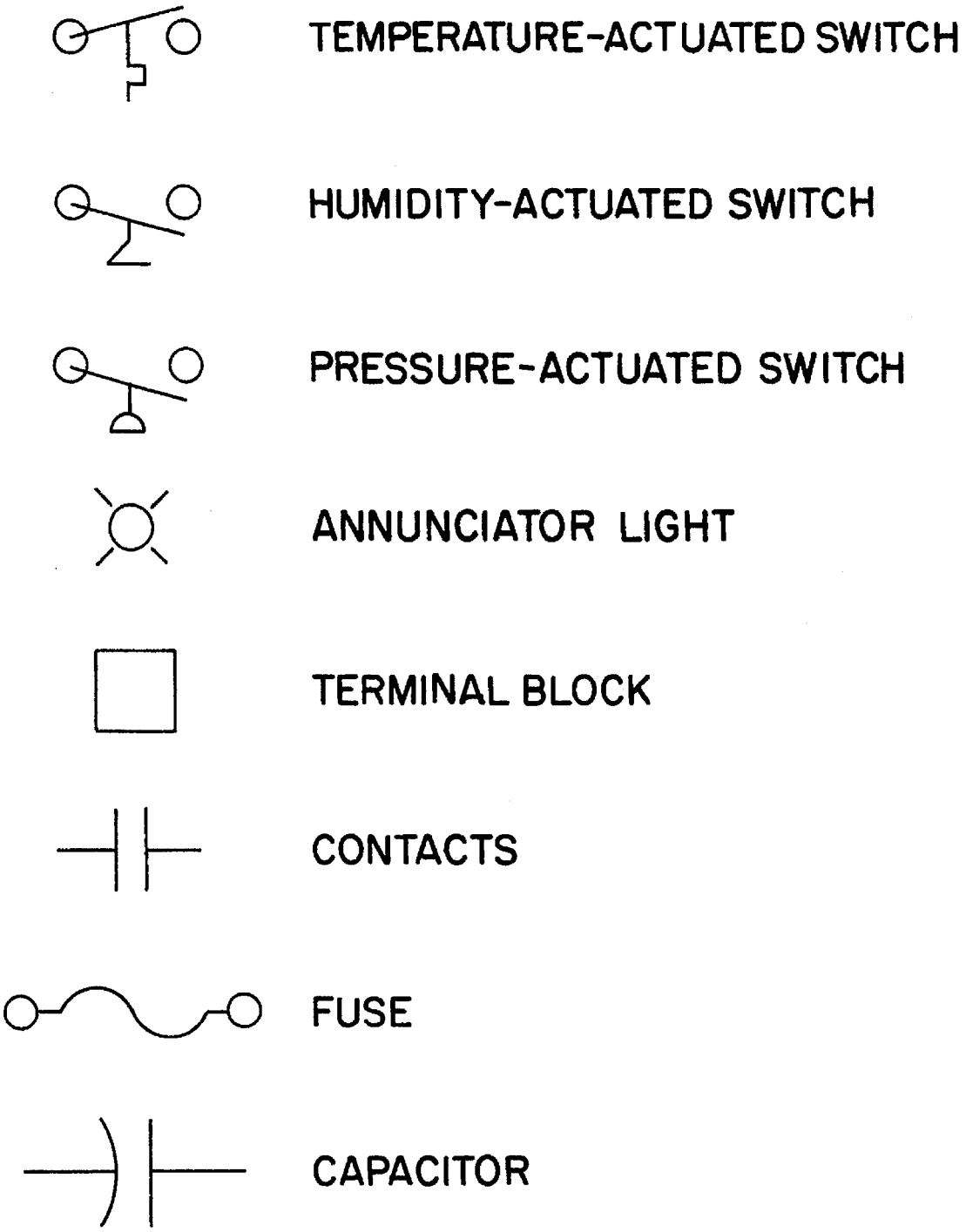
FIG. 4 is a simplified schematic legend of symbols used in the circuit diagram of FIG. 3.

A schematic circuit diagram of an electrical control circuit for the dehumidifier and water and air conditioning system of FIG. 1 is illustrated in FIG. 3. A legend of components labeled in the schematic circuit diagram of FIG. 3 is presented in Table I. The identification of various symbols is illustrated in FIG. 4. Highlights of the electrical control circuit are as follows.

Starting at the top of the circuit diagram is a controller 80 and motor 82 for the various three way valves. A variety of thermostats are provided in the system. A humidistat HU is positioned in the pool enclosure and a room cooling stat CS is also placed in the pool enclosure. An aquastat AQ is placed in the pool water for controlling pool water temperature. Finally a room heating thermostat HS is also placed in the discharge air stream. Relays R1, R2, R3, and R4 are associated with the respective thermostats and control contacts shown below identified by the same reference designations. The various relays control turning on and off of the compressor 20, enclosure air blower 84, water pump 40, and evaporative condenser blower 85, and operation of the three-way valves. The solenoid valve 86 controls pool water flow for heating pool water. Power supply is derived from transformer 87 and 120*v* line power. The crank case heater CCH for compressor 20 prevents condensation of refrigerant in the compressor during the off cycle. The compressor includes safety pressure switches HP, LP, shutting off the compressor if the pressure is either too high or too low. Other components are identified in the legends of Table I and FIG. 4 as readily understood by workers in the field of refrigeration and heat pumps.

Figure 5:
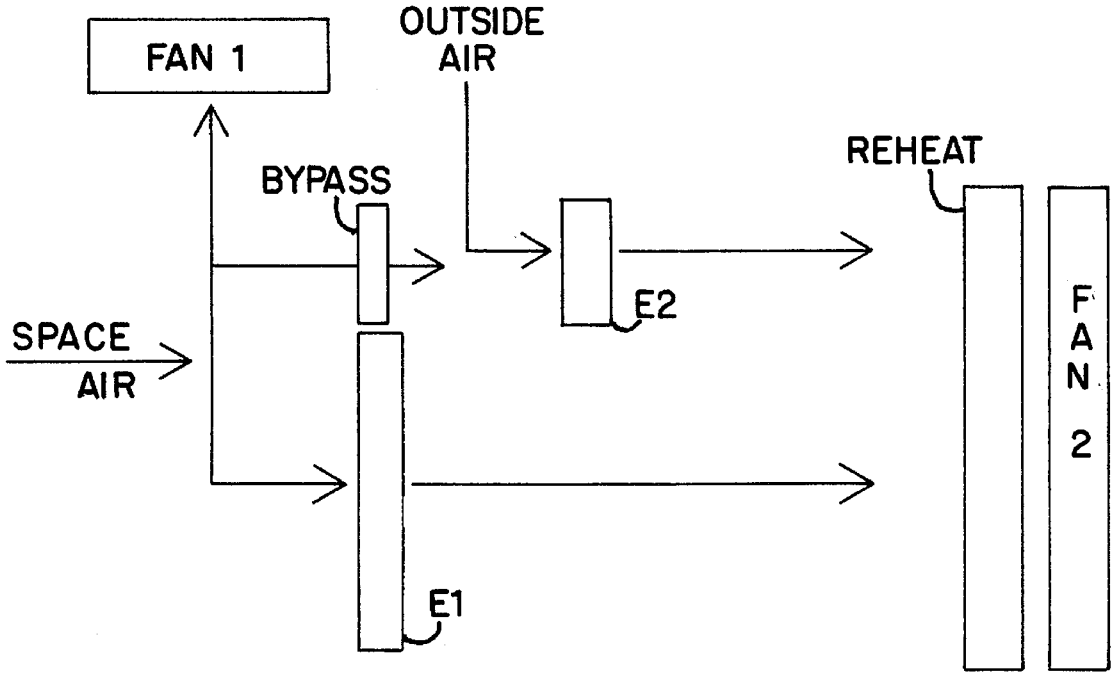
FIG. 5 is a simplified diagrammatic view of an air flow plan for the dehumidifier system.

An example air flow schematic diagram for the dehumidifier system is illustrated in FIG. 5. FAN1 vents some of the space air from the enclosure containing a source of humidity to the outside. FAN2 draws the enclosure air through the primary evaporator E1 where the air is chilled below dew point for removal of moisture. Some of the enclosure air passes through a BYPASS louver. Make-up air is drawn in from outside and chilled in a second supplemental refrigeration system evaporator E2. The conditioned air, bypass air, and outside air can be mixed to average parameters. The mixed air is reheated in the REHEAT coil and FAN2 returns; the dehumidified reheated air to the enclosure.

While the invention has been described with reference to particular example embodiments it is intended to cover all modifications and equivalents within the scope of the following claims.

TABLE I

| | |
|---|---|
| A1 | Dehumidify Light |
| A2 | Room Cooling Light |
| A3 | Pool Heating Light |
| A4 | Room Heating Light |
| A5 | Whirlpool Heating Light |
| ACT | Anti-Cycle Timer |
| AQ | Pool Water Aquastat |
| AQC | Evaporative Condenser Fan Aquastat |
| AQW | Whirlpool Water Aquastat |
| BAC | Blower Aux. Contact |
| BC | Blower Contactor |
| BOVL | Blower Overload |
| BSW | Blower Switch |
| CAC | Compressor Aux. Contact |
| CC | Compressor Contactor |
| CCH | Crackcase Heater |
| CS | Room Cooling Stat |
| CSW | Compressor Switch |
| F1–F4 | Fuse |
| HP | Head Pressure Switch |
| HS | Room Heating Stat |
| HU | Humidistat |
| L, L1, L2 | Line Power In |
| LP | Suction Pressure Switch |
| N | Line Neutral |
| PMP | Water Pump |
| PR | Potential Relay |
| R1 | Dehumidification Relay |
| R2 | Room Cooling Relay |
| R3 | Pool Heating Relay |
| R4 | Whirlpool Heating Relay |
| RC | Run Capacitor |
| RV1 | Water Heating 3-Way Valve |
| SC | Start Capacitor |
| SV | Solenoid Value |
| T1, T2 | Control Transformer |
| WP | Pool Water Pressure Switch |
| WV | Whirlpool Heating Valve |

We claim:

1. A heat pump system for dehumidifying air in an enclosure containing a source of humidity comprising:

a primary refrigerant loop of circulating refrigerant including a compressor for pressurizing refrigerant vapor, a primary condenser for extracting rejection heat from the refrigerant and condensing the refrigerant, and an evaporator for evaporating refrigerant and cooling air from the enclosure for condensing and extracting moisture from said air;

a secondary water loop coupled in heat exchange relationship both to the primary condenser for receiving the rejection heat from the refrigerant and to the source of humidity for heating the source of humidity with the rejection heat, said secondary water loop comprising a circulating water pump for circulating water in the secondary water loop, and a storage tank for storing said water containing the rejection heat;

and a water to air reheat coil coupled in the secondary water loop for reheating air from the enclosure with said rejection heat after extracting the moisture and before returning the air to the enclosure.

2. The heat pump system of claim 1 comprising an excess heat discharge heat exchanger (HX) coupled in the secondary water loop for discharging rejection heat outside the enclosure.

3. The heat pump system of claim 2 wherein the discharge HX is a water to air heat exchanger coupled in series with the water to air reheat coil in the secondary water loop, said water to air discharge HX being ducted with outside air.

4. The heat pump system of claim 3 comprising a multiway valve and multiple water lines coupled between the water to air reheat coil and outside discharge heat exchanger for bypassing the water to air reheat coil during a cooling mode of operation.

5. The heat pump system of claim 3 wherein the discharge heat exchanger is a water to air evaporative condenser.

6. The heat pump system of claim 1 wherein the source of humidity is an open receptacle of water and further comprising a water to water heat exchanger coupled in the secondary water loop for heating the receptacle water with rejection heat.

7. The heat pump system of claim 6 comprising a boiler coupled in the secondary water loop for adding heat to the heat pump system.

8. A heat pump system for dehumidifying air in an enclosure containing an open receptacle of water and for conditioning receptacle water and enclosure air, said heat pump system comprising:

a primary refrigerant loop of circulating refrigerant including a compressor for pressurizing refrigerant vapor, a primary condenser for extracting rejection heat from the refrigerant and for condensing the refrigerant, and an evaporator for evaporating refrigerant and cooling enclosure air for condensing and extracting moisture from the enclosure air;

a secondary water loop coupled in heat exchange relationship to the primary condenser for receiving rejection heat from the refrigerant, said secondary water loop comprising a circulating water pump for circulating water in the secondary water loop and a storage tank for storing the water containing said rejection heat;

a water to air reheat coil coupled in the secondary water loop for reheating enclosure air with said rejection heat after extracting moisture;

and a water to water heat exchanger coupled in the secondary water loop for heating receptacle water with rejection heat.

9. The heat pump system of claim 8 wherein the primary condenser is a plate type refrigerant to water condenser, and wherein the water to water heat exchanger coupled to the secondary loop for heating pool water comprises at least one plate type water heater.

10. The heat pump system of claim 8 comprising an excess heat discharge heat exchanger (HX) coupled in the secondary water loop for discharging rejection heat outside the enclosure.

11. The heat pump system of claim 10 comprising a multiway valve coupled in the secondary water loop between the water to air reheat coil and the discharge heat exchanger, said multiway valve being coupled to bypass the water to air reheat coil in the secondary water loop in a cooling mode of operation, to direct all water in the secondary water loop through the water to air reheat coil during a room air heat mode of operation, and to modulate water flow through the water to air reheat coil according to an air temperature sensor in the enclosure air returning from the reheat coil to the enclosure during a dehumidification mode of operation.

12. The heat pump system of claim 10 wherein the discharge heat exchanger is a cooling tower, said cooling tower being a water to air heat exchanger ducted with outside air.

13. The heat pump system of claim 10 comprising a boiler coupled in the secondary water loop for adding heat to the heat pump system.

14. The heat pump system of claim 10 wherein the discharge heat exchanger is an evaporative condenser outside the enclosure.

15. The heat pump system of claim 14 wherein the secondary water loop is constructed so that condensate from the evaporator in the refrigerant loop and condensate from the evaporative condenser in the secondary water loop are drained into the water storage tank in the secondary water loop.

16. A heat pump system for dehumidifying pool air and for conditioning pool water and pool air in a pool enclosure, said heat pump system having a primary circulating refrigerant loop including a compressor for pressurizing refrigerant vapor, a primary condenser for removing rejection heat from the refrigerant, an evaporator for adding heat to the refrigerant and cooling pool air for condensing and extracting moisture from the pool air, pool water heat exchanger for adding rejection heat to the pool water, a reheat coil for adding rejection heat to the pool enclosure air, and an excess heat discharge condenser for discharging excess rejection heat outside the pool enclosure, the improvement comprising:

a secondary water loop coupled in heat exchange relationship to the primary condenser for receiving the rejection heat from the refrigerant, said primary condenser being a refrigerant to water condenser;

a circulating water pump for circulating water in the secondary water loop and a water storage tank in the secondary water loop for storing water containing said rejection heat from the refrigerant;

said secondary water circulating loop being coupled to incorporate in the secondary water loop the reheat coil for reheating pool air, the pool water heat exchanger for heating pool water, and the discharge condenser for discharging excess rejection heat outside the pool enclosure.

17. The heat pump system of claim 16 wherein the primary condenser is a refrigerant to water condenser.

18. The heat pump system of claim 16 wherein the discharge condenser is a cooling tower comprising a water to air heat exchanger.

19. The heat pump system of claim 16 wherein the pool water heat exchanger comprises at least one water to water heat exchanger.

20. The heat pump system of claim 16 comprising a boiler coupled in the secondary water loop for adding heat to the system.

21. The heat pump system of claim 16 comprising a three way valve coupled in the secondary water loop between the water to air reheat coil and the discharge condenser, said three way valve being coupled to bypass the water to air reheat coil in the secondary water loop in a cooling mode of operation, to direct all water in the secondary water loop through the water to air reheat coil during a room air heat mode of operation, and to modulate water flow through the water to air reheat coil according to an air temperature sensor in the enclosure air returning from the reheat coil to the pool enclosure during a dehumidification mode of operation.

22. The heat pump system of claim 16 wherein the discharge condenser is a water to air evaporative condenser and wherein the secondary water loop is constructed so that condensate from the evaporator in the primary circulating refrigerant loop and condensate from the evaporative condenser in the secondary water loop are drained into the water storage tank in the secondary water loop.

* * * * *